US005672307A

United States Patent [19]

Shin et al.

[11] Patent Number: 5,672,307

[45] Date of Patent: Sep. 30, 1997

[54] FLASH SPINNING PROCESS

[75] Inventors: Hyunkook Shin, Wilmington; Roger Keith Siemionko, Hockessin, both of Del.

[73] Assignee: E. I. Du Pont de Nemours and Company, Wilmington, Del.

[21] Appl. No.: 612,714

[22] Filed: Mar. 8, 1996

[51] Int. Cl.[6] ..... D01D 5/11

[52] U.S. Cl. ..... 264/205; 264/211.14

[58] Field of Search ..... 264/13, 205, 211, 264/211.14

[56] References Cited

U.S. PATENT DOCUMENTS

| | | | |
|---|---|---|---|
| 3,851,023 | 11/1974 | Brethauer et al. | 264/205 X |
| 5,032,326 | 7/1991 | Shin | 264/13 |
| 5,147,586 | 9/1992 | Shin et al. | 264/13 |
| 5,250,237 | 10/1993 | Shin | 264/13 |
| 5,286,422 | 2/1994 | Kato et al. | 264/13 |
| 5,369,165 | 11/1994 | Kato et al. | 524/462 |

FOREIGN PATENT DOCUMENTS 5-263310 10/1993 Japan .

*Primary Examiner*—Leo B. Tentoni

[57] ABSTRACT

A process for producing plexifilamentary products by spinning from a solution of a primary solvent selected from the group consisting of methylene chloride and 1,2-dichloroethylene and a co-solvent, and a spin solution of a polyolefin dissolved in a primary solvent selected from the group consisting of methylene chloride, and 1,2-dichloroethylene, and a co-solvent.

6 Claims, No Drawings

FLASH SPINNING PROCESS

FIELD OF THE INVENTION

This invention relates to flash-spinning of polymeric plexifilamentary film-fibril strands. More particularly, this invention relates to a spin fluid that may be used in existing commercial equipment with minimum changes in the equipment, and to a spinning process using existing commercial equipment in which the spinning process does not release to the atmosphere ozone depletion components, and in which the spinning process is carried out in an atmosphere that is of low flammability.

BACKGROUND OF THE INVENTION

Commercial spunbonded products made from polyethylene plexifilamentary film-fibril strands have been produced by flash-spinning from trichlorofluoromethane; however, trichlorofluoromethane is an atmospheric ozone deletion chemical, and therefore, alternatives have been under investigation. Shin U.S. Pat. No. 5,032,326 discloses one alternative spin fluid, namely, methylene chloride and a co-solvent halocarbon having a boiling point between minus 50° C. and 0° C. As pointed out in Kato et al. U.S. Pat. No. 5,286,422, the Shin methylene chloride based process is not entirely satisfactory, and '422 discloses an alternative, namely, a spin fluid of bromochloromethane or 1,2-dichloroethylene and a co-solvent, e.g., carbon dioxide, dodecafluoropentane, etc.

Published Japanese Application JO5263310-A (published Oct. 12, 1993) discloses that three-dimensional fiber favorable for manufacturing flash spun non-woven sheet may be made from polymer dissolved in mixtures of solvents where the major component of the solvent mixture is selected from the group consisting of methylene chloride, dichloroethylene, and bromochloromethane, and the minor component of the solvent mixture is selected from the group consisting of dodecafluoropentane, decafluoropentane, and tetradecafluorohexane.

SUMMARY OF THE INVENTION

The present invention is a process for the preparation of plexifilamentary film-fibril strands of synthetic fiber-forming polyolefin which comprises flash-spinning at a pressure that is greater than the autogenous pressure of the spin fluid into a region of lower pressure, a spin fluid consisting essentially of (a) 5 to 30 wt. % synthetic fiber-forming polyolefin, (b) a primary solvent selected from the group consisting of methylene chloride and 1,2-dichloroethylene, and (c) a co-solvent selected from the group consisting of hydrofluoroethers and cyclic perfluorinated hydrocarbons said co-solvent having (i) 3 to 7 carbon atoms and (ii) an atmospheric boiling point between 15° and 100° C., said co-solvent being present in the spin fluid in an amount sufficient to raise the cloud point pressure of the spin fluid by at least 50 pounds per square inch.

Suitable co-solvents are selected from the group consisting of 1,1,1,2,3,3-fluoropropyl methyl ether; 1,1,1,2,2,3,3-fluoropropyl 1,2,2,2-fluoroethyl ether, i.e., $CF_3CF_2CF_2$-0-$CHFCF_3$; 1,1,1,2,2,3,3,4,4-fluorobutyl methyl ether; 1,1,1,2,2,3,3,4,4-fluorobutyl ethyl ether; perfluorodimethylcyclobutane; perfluoro-N-methylmorpholine; and 1,2,3,3,4,4-fluoro,1,2-trifluoromethyl cyclobutane.

A preferred synthetic fiber-forming polyolefin is linear polyethylene, and an alternative is isotactic polypropylene.

This invention is also a spin fluid consisting essentially of (a) 5 to 30 wt. % synthetic fiber-forming polyolefin, (b) a primary solvent selected from the group consisting of methylene chloride and 1,2-dichloroethylene, and (c) a co-solvent selected from the group consisting of hydrofluoroethers and cyclic perfluorinated hydrocarbons said co-solvent having (i) 3 to 7 carbon atoms and (ii) an atmospheric boiling point between 15° and 100° C., said co-solvent being present in the spin fluid in a amount sufficient to raise the cloud point pressure of the spin fluid by at least 50 pounds per square inch.

A suitable co-solvent is selected from the group consisting of 1,1,1,2,3,3-fluoropropyl methyl ether; 1,1,1,2,2,3,3-fluoropropyl 1,2,2,2-fluoroethyl ether; 1,1,1,2,2,3,3,4,4-fluorobutyl methyl ether; 1,1,1,2,2,3,3,4,4-fluorobutyl ethyl ether; perfluorodimethylcyclobutane; perfluoro-N-methylmorpholine; and 1,2,3,3,4,4-fluoro, 1,2-trifluoromethyl cyclobutane.

In the preferred spin fluid the synthetic fiber-forming polyolefin is linear polyethylene.

The preferred processes employees a spin fluid in which the synthetic fiber-forming polyolefin concentration is in the range of 8 to 18 wt. % of the fluid.

In the preferred process the amount of co-solvent is sufficient to raise the cloud point pressure of the spin fluid by at least 200 psig.

DETAILED DESCRIPTION OF THE INVENTION

The term "synthetic fiber-forming polyolefin" is intended to encompass the classes of polymers disclosed in the flash-spinning art.

The term "polyethylene" as used herein is intended to encompass not only homopolymers of ethylene, but also copolymers wherein at least 85% of the recurring units are ethylene units. One preferred polyethylene is linear high density polyethylene which has an upper limit of melting range of about 130° to 140° C., a density in the range of 0.94 to 0.98 gram per cubic centimeter, and a melt index (as defined by ASTM D-1238-57T Condition E) of between 0.1 and 100, preferably less than 4.

The term "polypropylene" is intended to embrace not only homopolymers of propylene but also copolymers where at least 85% of the recurring units are propylene units.

The term "cloud-point pressure" as used herein, means the pressure at which a single phase liquid solution starts to phase separate into a polymer-rich/spin liquid-rich two-phase liquid/liquid dispersion.

To raise the cloud-point pressure the co-solvent in the spin fluid must be a "non-solvent" for the polymer, or at least a poorer solvent than the primary solvent: i.e., methylene chloride or 1,2-dichloroethylene. (In other words, the solvent power of the co-solvent of the spin fluid used must be such that if the polymer to be flash-spun were to be dissolved in the co-solvent alone, the polymer would not dissolve in the co-solvent, or the resultant solution would have a cloud-point pressure greater than about 7000 psig.)

Methylene chloride and 1,2-dichloroethylene are such good solvents for the polyolefins that are commercially employed in the formation of flash spun products: i.e., polyethylene and polypropylene, that the cloud-point pressure is so close to the bubble point that it is not possible to operate efficiently. By employing one of the co-solvents listed above, the solvent power of the mixture is lowered sufficiently that flash spinning to obtain the desired plexifilamentary product is readily accomplished.

In order to spread the web formed when polymers are flash spun in the commercial operations, the flash spun material is projected against a rotating baffle: see, for example, Brethauer et al. U.S. Pat. No. 3,851,023, and then subjected to an electrostatic charge. The baffle causes the product to change directions and start to spread, and the electrostatic charge causes the product (web) to further spread. In order to achieve a satisfactory commercial product in a commercially acceptable time, it is necessary that the web achieve a significant degree of spread, and this can be achieved only if sufficient electrostatic charge remains on the web for the desired time. The charge will dissipate too rapidly if the atmosphere surrounding the web has too low a dielectric strength. A major component of the atmosphere surrounding the web is the vaporized solvents that, prior to flash spinning, dissolved the polymer which was flash spun. The mixtures of a primary solvent selected from the group consisting of methylene chloride and 1,2-dichloroethylene and the co-solvents listed above, when vaporized, have a dielectric strength sufficient to maintain sufficient electric charge on the web to insure a satisfactory product. These mixtures have a dielectric strength as measured by ASTM D-2477 of greater than about 40 kilovolts per centimeter.

Because the mixture of solvents has a boiling point that is near room temperature, a high pressure solvent recovery system is not necessary; furthermore, a high pressure solvent injection system is not necessary.

The solvent mixtures of the present invention are of low flammability.

The amount of co-solvent employed with the primary solvent selected from the group consisting of methylene chloride and 1,2-dichloroethylene will usually be in the range of about 10 to 30 parts by weight per hundred parts by weight of the solvent mixture.

Test Methods:

The tenacity of the flash-spun strand is determined with an Instron tensile-testing machine. The strands are conditioned and tested at 70° F. and 65% relative humidity. The sample is then twisted to 10 turns per inch and mounted in jaws of the Instron Tester. A 2-inch gauge length and an elongation rate of 100% per minute are used. The tenacity (T) at break is recorded in grams per denier.

Denier of the strand is determined from the weight of a 18 cm sample length of the strand.

Elongation of the flash-spun strand is measured as elongation at break and is reported as a percentage.

EXAMPLES

The apparatus and process for carrying out the examples is as described in U.S. Pat. No. 5,250,237 at column 10 and following. U.S. Pat. No. 5,250,237 is incorporated herein by reference. The spinneret employed had an orifice with 30 mil diameter and a 30 mil land.

Example 1

12 wt. % high density polyethylene having a melt index of 0.75 was dissolved in a mixture of methylene chloride and 1,1,1,2,2,3,3-fluoropropyl 1,2,2,2-fluoroethyl ether in which the weight percent ratio of primary solvent, methylene chloride to the ether was 75/25 at 210° C. and a pressure of 4000 psig. The solution was spun at an accumulator pressure of 2500 psig and at a spin pressure of 2340 psig at 210° C. A plexifilamentary product was obtained having a denier of 296, a tenacity of 3.8 grams per denier, and a percent elongation at break of 80.

Example 2

The process of Example 1 was repeated using as the primary solvent trans-1,2-dichloroethylene and the co-solvent was 1,1,1,2,3,3-fluoropropyl methyl ether, and the weight percent ratio of 1,2-dichloroethylene to ether was 80/20, the polyethylene was dissolved at 1400 psig, and spun at 1410 psig. The product was a plexifilament having a denier of 266, a tenacity of 2.35 grams per denier, and an elongation at break of 99%.

Example 3

The process of Example 1 was repeated except the co-solvent was perfluoro-N-methylmorpholine, and the weight percent ratio of methylene chloride to co-solvent was 80/20, the polyethylene was dissolved at 200° C. and at a pressure of 3000 psig, and spun at an accumulator pressure of 1000 psig and at a spin pressure of 950 psig at 200° C. The product was a plexifilament having a denier of 197, a tenacity of 4.5 grams per denier, and a percent elongation at break of 66.

Example 4

The process of Example 1 was repeated except that the co-solvent was perfluorodimethylcyclobutane, and the weight percent ratio of methylene chloride to co-solvent was 80/20, and the polyethylene was dissolved at 200° C. at a pressure of 2500 psig, and spun at 200° C. using an accumulator pressure of 1600 psig and at actual spin pressure of 1480 psig. The product was a plexifilament and had a denier of 306, a tenacity of 3.3 grams per denier, and an elongation at break of 83%.

Example 5

The process of Example 1 was repeated using as the primary solvent trans-1,2-dichloroethylene, and the co-solvent was 1,1,1,2,2,3,3-fluoropropyl 1,2,2,2-fluoroethyl ether. 12 wt. % of the polyethylene was dissolved in a mixture of the solvents. The solvent was of 85 wt. % primary solvent and 15 wt. % co-solvent. The polymer was mixed at 210° C. and 2000 psig and spun at 1400 psig accumulator pressure. Actual spin pressure during spinning was 1300 psig. The product was a plexifilament with a denier of 233, a tenacity of 1.93 grams per denier, and an elongation at break of 100%.

Example 6

12 wt. % high density polyethylene (melt index of 0.75) was dissolved in 82.5 wt. % trans-1,2-dichloroethylene and 17.5 wt. % perfluoro-N-methylmorpholine. The polymer and solvent were mixed at 210° C. at 2500 psig for 30 minutes, and spun at 211° C. at an accumulator pressure of 1300 psig, and at actual spin pressure of 1000 psig. The product had a denier of 237, a tenacity of 1.63 grams per denier, and an elongation at break of 122%.

Example 7

12 wt. % high density polyethylene (melt index of 0.75) was dissolved in 82.5 wt. % trans-1,2-dichloroethylene and 17.5 wt. % perfluorodimethylcyclobutane. The polymer and solvent were mixed at 200° C. at 2500 psig for 30 minutes, and spun at 200° C. at an accumulator pressure of 900 psig, and at actual spin pressure of 700 psig. The product had a denier of 168, a tenacity of 2.08 grams per denier, and an elongation at break of 120%.

What is claimed is:

1. A process for the preparation of plexifilamentary film-fibril strands of synthetic fiber-forming polyolefin which comprises:

generating a spin fluid consisting essentially of (a) 5 to 30 wt. % synthetic fiber-forming polyolefin, (b) a primary solvent selected from the group consisting of methylene chloride and 1,2-dichloroethylene, and (c) a co-solvent selected from the group consisting of hydrofluoroethers and cyclic perfluorinated hydrocarbons said co-solvent having (i) 3 to 7 carbon atoms and (ii) an atmospheric boiling point between 15° and 100° C., said co-solvent being present in the spin fluid in an amount sufficient to raise the cloud point pressure of the spin fluid by at least 50 pounds per square inch; and flash-spinning the spin fluid at a pressure that is greater than the autogenous pressure of the spin fluid into a region of lower pressure to form plexifilamentary film-fibril strands of said synthetic fiber forming polyolefin.

2. The process of claim 1 in which the co-solvent is selected from the group consisting of 1,1,1,2,3,3-fluoropropyl methyl ether; 1,1,1,2,2,3,3-fluoropropyl 1,2,2,2-fluoroethyl ether; 1,1,1,2,2,3,3,4,4-fluorobutyl methyl ether; 1,1,1,2,2,3,3,4,4-fluorobutyl ethyl ether; perfluorodimethylcyclobutane; perfluoro-N-methylmorpholine; and 1,2,3,3,4,4-fluoro,1,2-trifluoromethyl cyclobutane.

3. The process of claim 2 in which the synthetic fiber-forming polyolefin is linear polyethylene.

4. The process of claim 2 in which the synthetic fiber-forming polyolefin is isotactic polypropylene.

5. The process of claim 1 in which the spin fluid contains 8 to 18 wt. % synthetic fiber-forming polyolefin.

6. The process of claim 1 in which the co-solvent is present in the spin fluid in an amount sufficient to raise the cloud point pressure of the spin fluid by at least 200 pounds per square inch.

* * * * *